US010731930B2

(12) United States Patent
Wilson et al.

(10) Patent No.: US 10,731,930 B2
(45) Date of Patent: Aug. 4, 2020

(54) TANK FOR HEAT EXCHANGER AND METHOD FOR MANUFACTURING THE TANK

(71) Applicant: DENSO International America, Inc., Southfield, MI (US)

(72) Inventors: Nicholas Wilson, Grosse Pointe Park, MI (US); Justin Harris, Southfield, MI (US)

(73) Assignee: DENSO International America, Inc., Southfield, MI (US)

( * ) Notice: Subject to any disclaimer, the term of this patent is extended or adjusted under 35 U.S.C. 154(b) by 133 days.

(21) Appl. No.: 15/874,047

(22) Filed: Jan. 18, 2018

(65) Prior Publication Data

US 2019/0219345 A1 Jul. 18, 2019

(51) Int. Cl.

| | |
|---|---|
| ***F28F 9/02*** | (2006.01) |
| ***F28F 9/00*** | (2006.01) |
| ***F28D 1/053*** | (2006.01) |
| ***F28F 21/08*** | (2006.01) |
| ***B21D 53/02*** | (2006.01) |
| ***F28F 1/12*** | (2006.01) |

(52) U.S. Cl.

CPC ..... *F28F 9/0221* (2013.01); *B21D 53/02* (2013.01); *F28D 1/05366* (2013.01); *F28F 9/001* (2013.01); *F28F 9/0226* (2013.01); *F28F 21/084* (2013.01); *F28F 1/126* (2013.01); *F28F 2230/00* (2013.01); *F28F 2255/00* (2013.01); *F28F 2255/143* (2013.01); *F28F 2275/122* (2013.01)

(58) Field of Classification Search

CPC ..... F28F 9/0226; F28F 9/14; F28F 9/0221; F28F 9/001; F28D 1/05366

See application file for complete search history.

(56) References Cited

U.S. PATENT DOCUMENTS

| | | | | |
|---|---|---|---|---|
| 4,023,618 | A * | 5/1977 | Kun | F28D 9/00 165/175 |
| 4,997,035 | A * | 3/1991 | Beatenbough | F28F 9/0226 165/149 |
| 5,178,213 | A * | 1/1993 | Watson | F28D 1/05366 165/173 |
| 6,223,812 | B1 * | 5/2001 | Gough | F28D 1/05366 165/173 |

(Continued)

FOREIGN PATENT DOCUMENTS

| | | | |
|---|---|---|---|
| JP | H08247689 | A | 9/1996 |
| JP | H11142091 | A | 5/1999 |
| JP | 2006-250383 | A | 9/2006 |

*Primary Examiner* — Jon T. Schermerhorn, Jr.

(57) ABSTRACT

A tank portion defines a space therein and has an opening on one side. A foot portion is in a plate shape extending radially outward from a bottom end of the tank portion on the one side. A core plate covers the opening and has a base portion and a holder portion. The base portion is in an elongated rectangular plate shape having first and second long lateral sides and a short lateral side. The holder portion includes a first holder at the first long lateral side, a second holder at the second long lateral side, and a third holder at the short lateral side, each gripping the foot portion. All the first holder, the third holder, and the second holder are one piece continuously extending along the first long lateral side, the short lateral side, and the second long lateral side.

7 Claims, 14 Drawing Sheets

(56) References Cited

U.S. PATENT DOCUMENTS

| | | | | |
|---|---|---|---|---|
| 7,207,377 | B2 | 4/2007 | Sonoda et al. | |
| 10,126,064 | B2 * | 11/2018 | Takeuchi | F01P 3/18 |
| 2004/0244954 | A1 | 12/2004 | Goto et al. | |

* cited by examiner

TANK FOR HEAT EXCHANGER AND METHOD FOR MANUFACTURING THE TANK

TECHNICAL FIELD

The present disclosure relates to a tank for a heat exchanger. The present disclosure further relates a method for manufacturing the tank.

BACKGROUND

A vehicle is generally equipped with a heat exchanger for a thermal system. A heat exchanger generally includes a tank for receiving thermal medium.

SUMMARY

According to an aspect of the disclosure, a tank for a heat exchanger includes a tank part and a core plate. The tank part is affixed to the core plate.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION

Example

Figure 15:
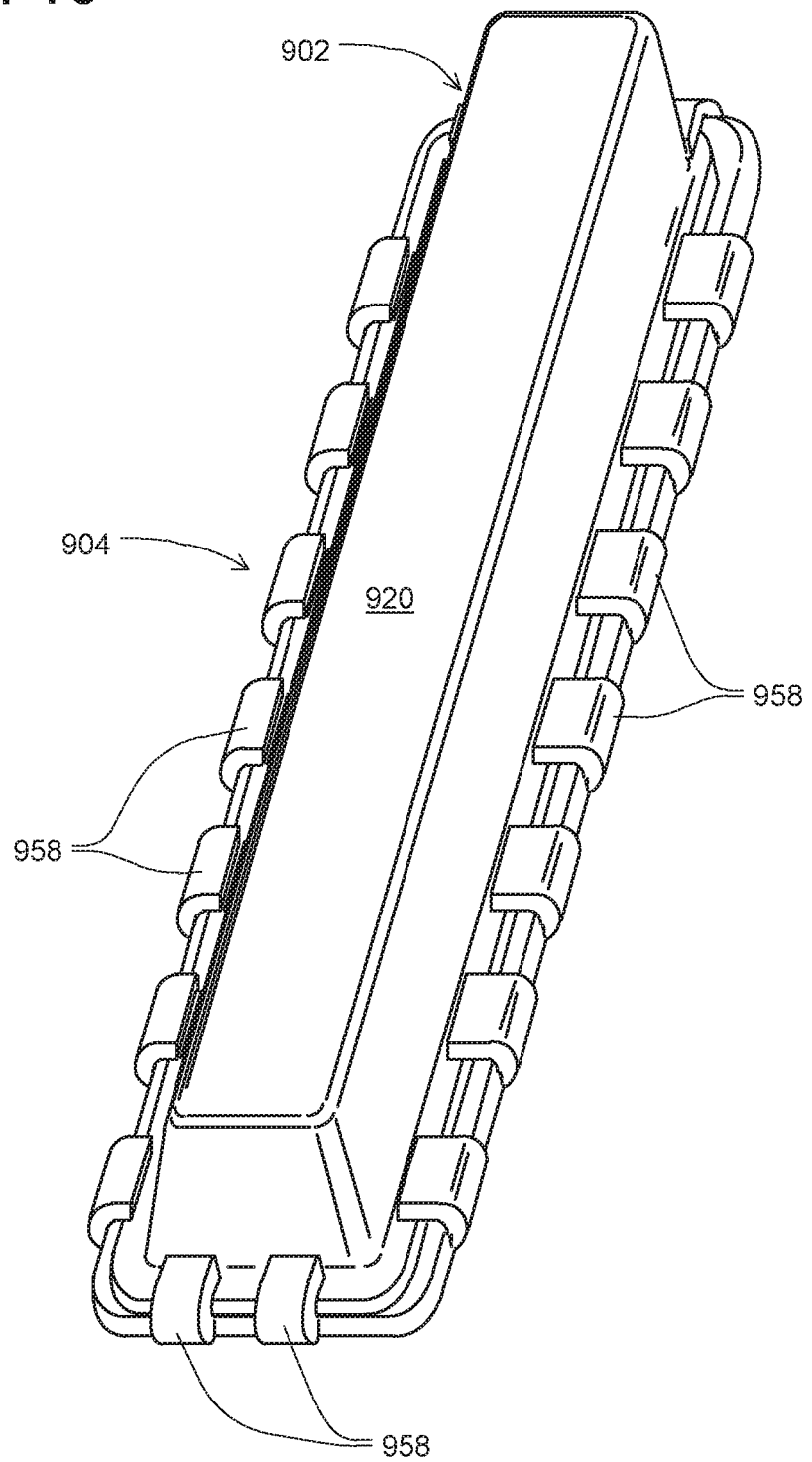
FIG. 15 is a perspective view showing an example of a tank.

FIG. 15 shows an example of a tank 920 for a heat exchanger. The tank 920 includes a tank part 902 and a core plate 904. The core plate 904 has multiple tabs 958 arranged along its periphery. The tabs 958 are crimped onto the tank part 902 thereby to affix the tank part 902 to the core plate 904. The tank part 902 and the core plate 904 interpose a seal member (not shown) therebetween. In this example, the tabs 958 are segmented into a large number of pieces. This example therefore may result in inconsistent seal between the tank part 902 and the core plate 904. In addition, the segmented tabs 958 may need enhanced rigidity to securely grip the tank part 902 and the seal member to prevent leakage of internal liquid. The segmented tabs 958 may require a large number of manufacturing processes to crimp the tabs 958.

According to one aspect of the disclosure, a tank has a slide-in configuration where a tank part is inserted along holders of a core plate. The holders are continuous along long lateral sides of the core plate, respectively. This configuration may enable consistent sealing and may require less manufacturing process.

First Embodiment

As follows, a first embodiment of the present disclosure will be described with reference to drawings.

(Coolant System)

Figure 1:
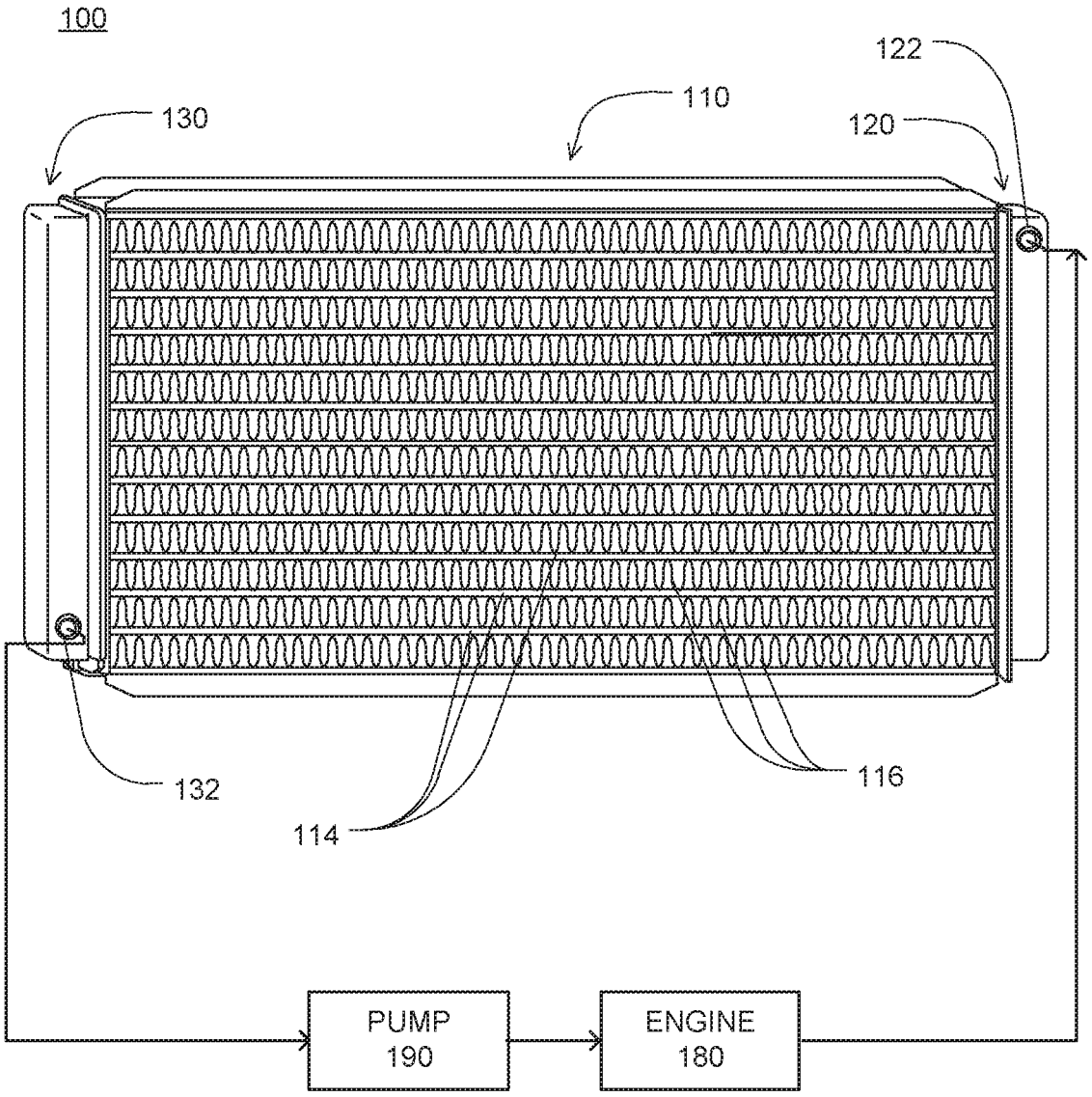
FIG. 1 is a perspective view showing a thermal system including a heat exchanger.

FIG. 1 shows a coolant system including a radiator 100. The radiator 100 is an example of a heat exchanger for a vehicle. The radiator 100 is a part of a coolant system for cooling an internal combustion engine 110. The coolant system includes the radiator 100, the engine 180, and a pump 190, which are connected with each other via conduits. The pump 190 pumps coolant into the engine 180 and circulates the coolant through the radiator 100. The radiator 100 conducts heat exchange between the coolant flowing through the radiator 100 and air passing through the radiator 100.

(Radiator)

The radiator 100 includes a core 110, an inlet tank 120, and an outlet tank 130. The core 110 is interposed between the inlet tank 120 and the outlet tank 130. The core 110 includes tubes 114 and fins 116. The tubes 114 and fins 116 are stacked one another and brazed together. The tubes 114 are connected with the inlet tank 120 and the outlet tank 130. Each of the tubes 114 is in a planar shape and defines a coolant passage to conduct coolant therethrough. Each of the fins 116 is in a wave shape. The fins 116 and the tubes 114 form airflow passages. The airflow passages are directed toward a front grill of the vehicle. As the vehicle travels, ram air flows through the airflow passages. In addition, a fun device (not shown) is installed to the radiator 100 to generate airflow through the radiator 100. The fins 116 and tubes 114 conduct heat exchange between the air passing through the airflow passages and coolant flowing through the tubes 114.

The inlet tank 120 has an inlet port 122 connected with a coolant outlet port of the engine 180 through the conduit. The outlet tank 130 has an outlet port 132 connected with a coolant inlet port of the engine 180 through the conduit. In the present example, the radiator 100 has a single pass structure to conduct coolant from the inlet tank 120 through the core 110 to the outlet tank 130.

While the coolant passes through the core 110, the coolant and the ram air conduct heat exchange therebetween to cool the coolant. In this way, the coolant system is configured to cool the engine 180 by using circulating coolant.

The radiator 100 may be used in a low-temperature radiator system (LTR system) for cooling a battery and/or a power electronics device.

(Construction of Tank)

As follows, a construction of the tank will be described in detail. In the following description, the inlet tank 120 will be described as an example. In the following description and related drawings, the inlet port 122 is omitted.

Figure 2:
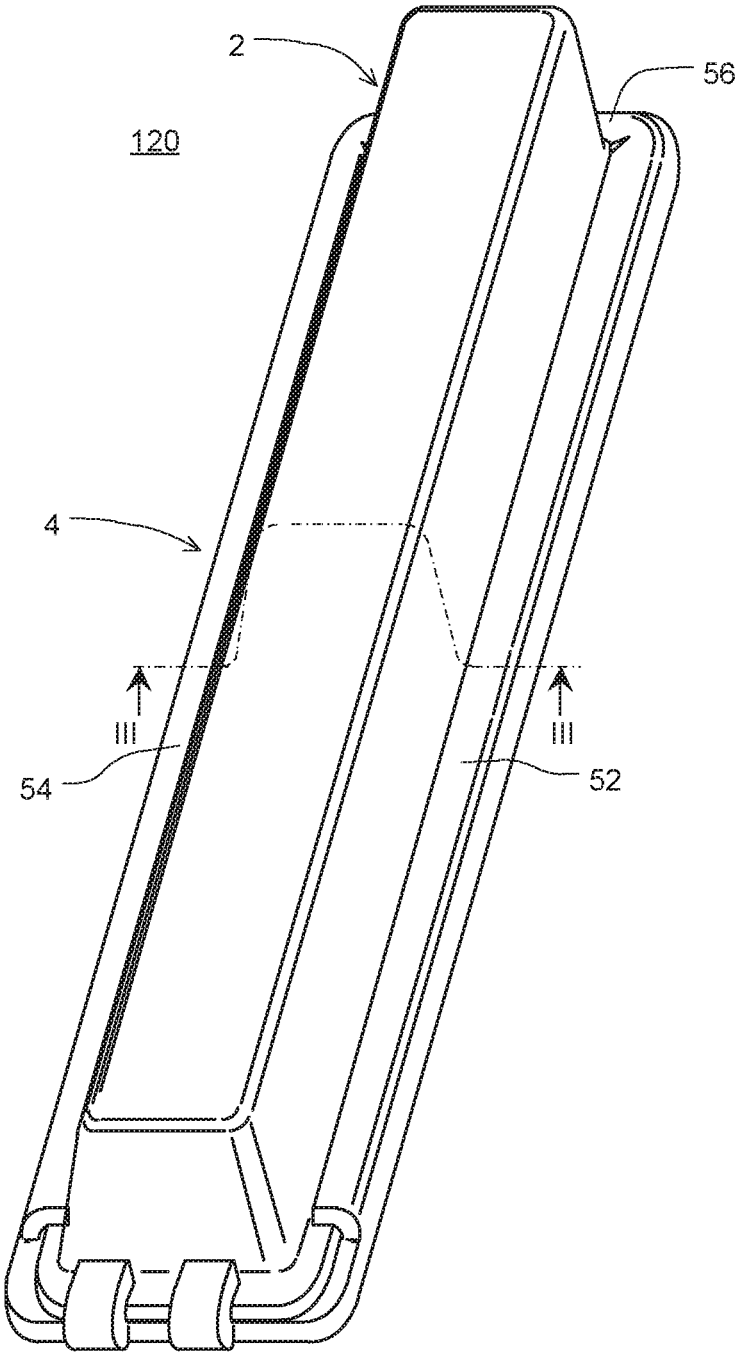
FIG. 2 is a perspective view showing a tank for the heat exchanger.

As shown in FIG. 2, the tank 120 is a container elongated along a longitudinal direction. The tank 120 includes a tank part 2 and a core plate 4. The tank part 2 is affixed to the core plate 4 to form a hollow cavity. In the present example, the tank part 2 is formed of a resin material, such as glass-filled nylon by injection molding. The core plate 4 is formed of a ductile metallic material such as an aluminum alloy.

Figure 3:
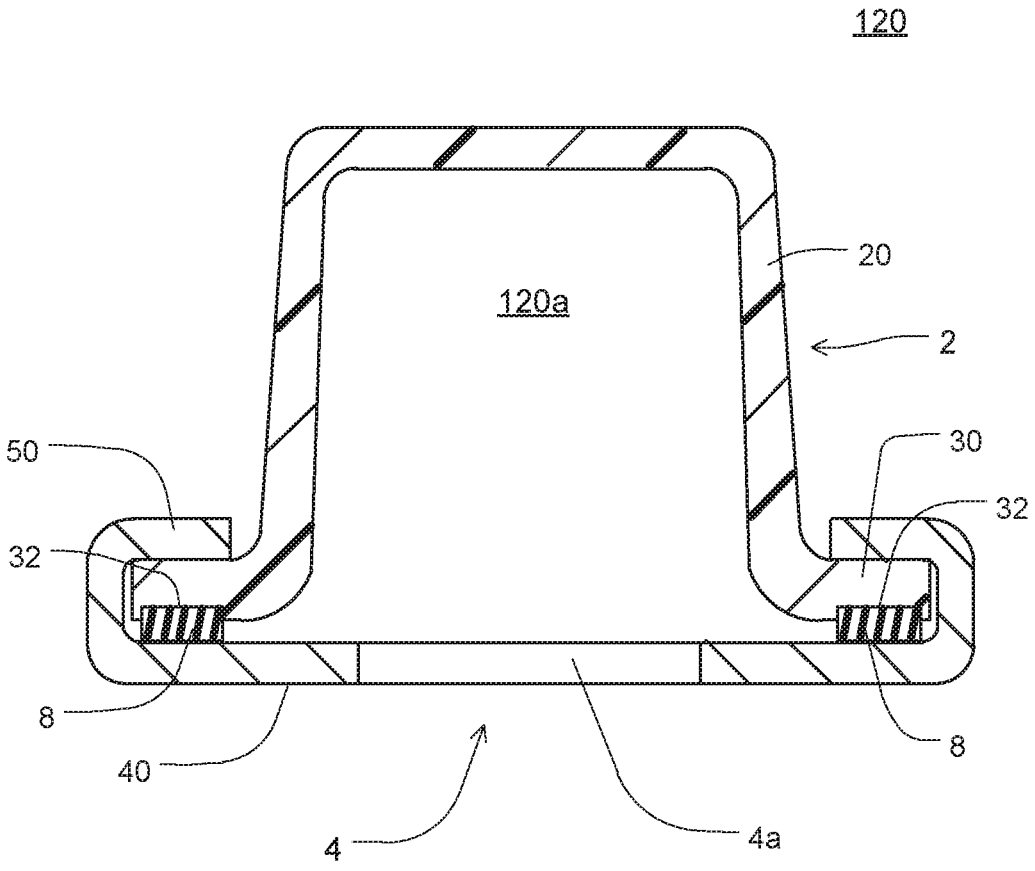
FIG. 3 is a cross sectional view taken along a line III-III in FIG. 2.

FIG. 3 is a cross sectional view taken along the line III-III in FIG. 2. In FIG. 3, the tank part 2 has a trapezoidal cross section. The trapezoidal cross section of the tank part 2 is one example. The cross section of the tank part 2 may be in a hemi circular shape. The core plate 4 entirely has a C-shaped cross section. The core plate 4 has a center portion defining openings 4*a*. The openings 4*a* are to be inserted with the tubes 114 (FIG. 1), respectively.

A seal member 8 is interposed between the tank part 2 and the core plate 4. The seal member 8 is formed of an elastomer such as EPDM rubber.

The tank part 2 and the core plate 4 form a tank cavity 120*a*. The seal member 8 liquid-tightly seals the interface between the tank part 2 and the core plate 4. The tank cavity 120*a* communicates with an exterior of the tank 120 through the openings 4*a*.

The tank part 2 has a tank portion 20 and a foot portion 30. The foot portion 30 extends radially outward from a bottom end of the tank portion 20. In the present example, the foot portion 30 has a recess 32 at its underneath. The recess 32 accommodates an upper portion of the seal member 8.

The core plate 4 has a base portion 40 and a holder portion 50 which are integrally formed as one piece. The base portion 40 is in a plate shape having a flat bottom surface. The holder portion 50 has a U-shaped cross section on each side. The holder portion 50 grips the foot portion 30 and the seal member 8.

The tank cavity 120*a* is configured to receive pressurized coolant and is exerted with internal pressure. In the present configuration, the holder portion 50 of the core plate 4 rigidly holds the foot portion 30. In addition, the seal member 8 restricts leakage of the coolant from the tank cavity 120*a* to the outside of the tank 120.

(Components of Tank)

Figure 4A:
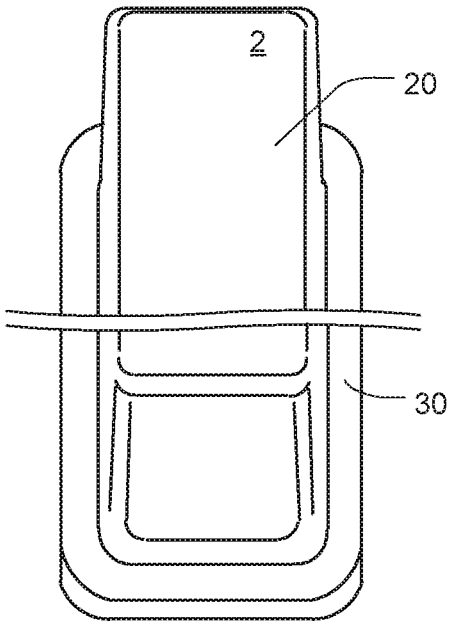
FIG. 4A is a perspective view showing a tank part.
Figure 4B:
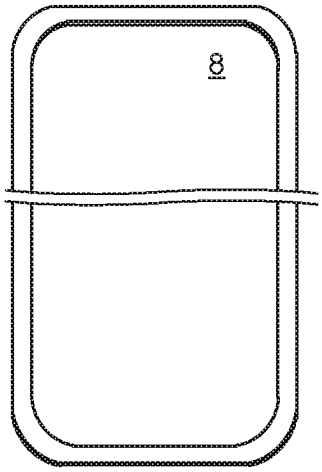
FIG. 4B is a perspective view showing a sealing member.
Figure 4C:
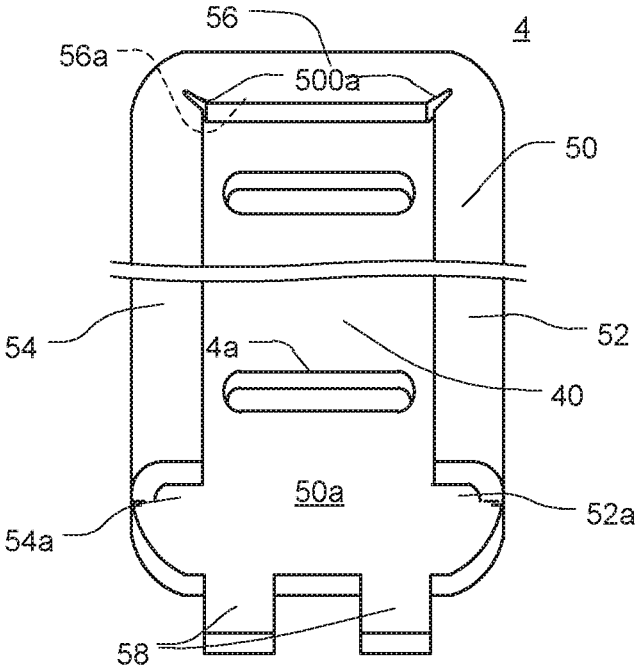
FIG. 4C is a perspective view showing a core plate.

FIGS. 4A to 4C are perspective views showing the tank part 2, the seal member 8, and the core plate 4. The components as illustrated are reduced in size with respect to the longitudinal direction.

(Tank Part)

In FIG. 4A, the foot portion 30 extends radially from the entire periphery of the bottom end of the tank portion 20 and entirely surrounds the periphery of the bottom end. The foot portion 30 forms an annular-shaped flange of the tank part 2.

(Seal Member)

The seal member 8 is in an annular shape. The seal member 8 has an outer periphery slightly smaller than an outer periphery of the foot portion 30 of the tank part 2. The seal member 8 has an inner periphery slightly larger than an inner periphery of the foot portion 30.

(Core Plate)

In FIG. 4C, the base portion 40 is in an elongated rectangular plate shape having two long lateral sides and two short lateral sides. The holder portion 50 surrounds the two long lateral sides and one short lateral side of the base portion 40. The holder portion 50 is in a C-shape when viewed from the top in the drawing. The holder portion 50 opens on the upper side and further opens at one short lateral side.

The holder portion 50 includes a first holder 52, a second holder 54, and a third holder 56. The first holder 52 and the second holder 54 are located at the two long lateral sides, respectively. Each of The first holder 52 and the second holder 54 is one piece continuously extending linearly along corresponding one of the long lateral sides. The third holder 56 is located at the one short lateral side. The third holder 56 is one piece continuously extending linearly along the other short lateral side.

The first holder 52 and the second holder 54 have a U-shaped cross section forming a first linear channel 52*a* and a second linear channel 54*a*, respectively. The first linear channel 52*a* and second linear channel 54*a* continuously extend linearly along the long lateral sides of the base portion 40. The third holder 56 has a U-shaped cross section forming a third linear channel 56*a*. The third linear channel 56*a* continuously extends linearly along the other short lateral side.

The holder portion 50 and the base portion 40 form a slot 50*a* at the one short lateral side. The slot 50*a* linearly extends along the bottom surface of the base portion 40. The slot 50*a* serves as an insertion opening for the tank part 2.

The core plate 4 further has tabs 58 integrally formed with the base portion 40. The tabs 58 extend radially outward from the one short lateral end of the base portion 40. Each of the tabs 58 is in a rectangular shape. In the present example, the core plate 4 has two tabs 58.

(Assemble Process)

As follows, an assembling process of the tank 120 will be described with reference to FIGS. 5 to 8.

Figure 5:
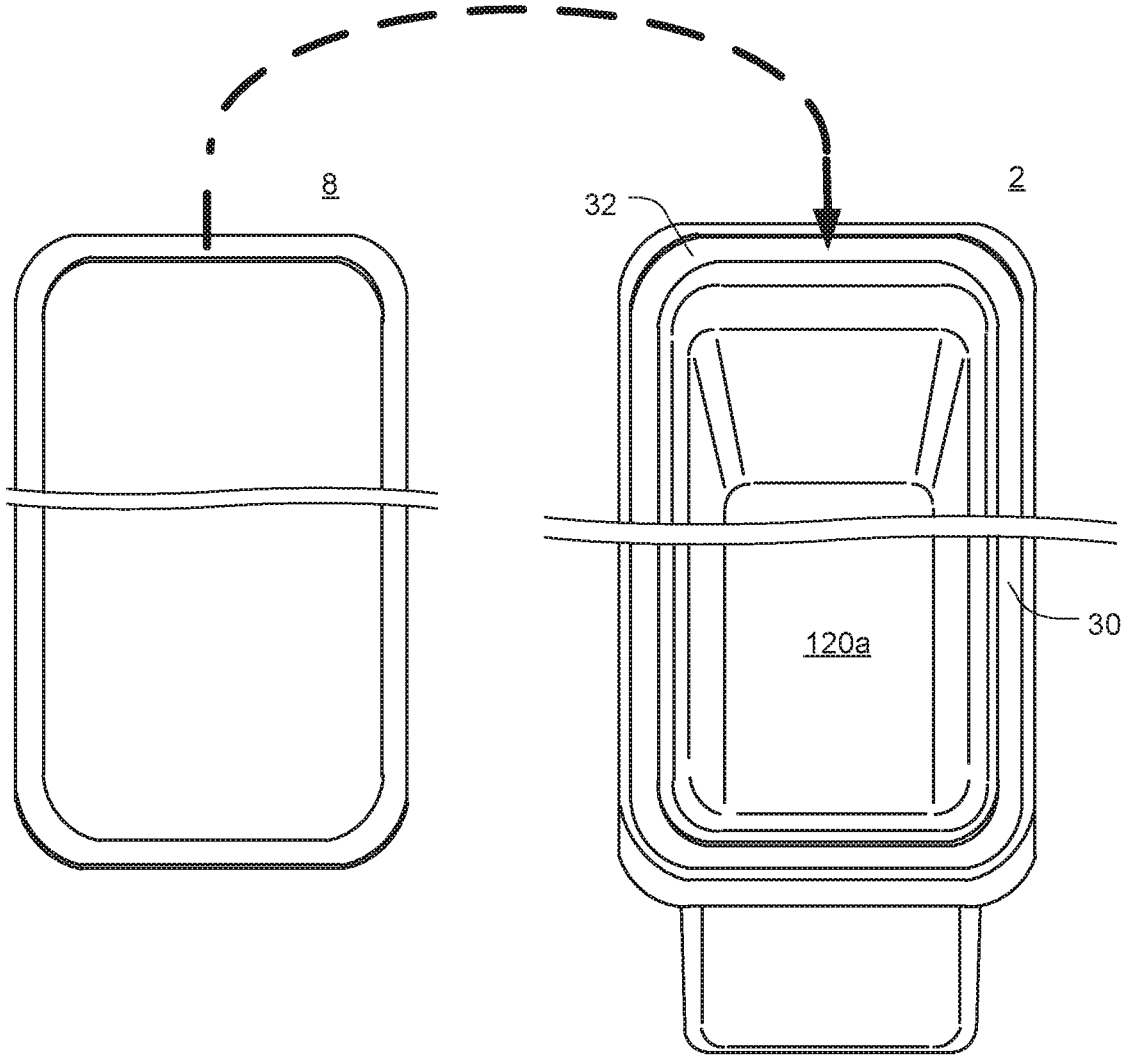
FIGS. 5 to 8 are perspective views showing a manufacturing process for the tank.

In FIG. 5, the seal member 8 is first mounted to the underneath of the foot portion 30 of the tank part 2. Specifically, in the present example, the seal member 8 is adhered with glue onto the lower surface of the recess 32 of the foot portion 30. Alternatively, the seal member 8 may be heated and baked onto the lower surface of the recess 32. The seal member 8 is placed within the outer periphery of the foot portion 30 to surround an outer periphery of a bottom end of the tank cavity 120*a*.

Figure 6:
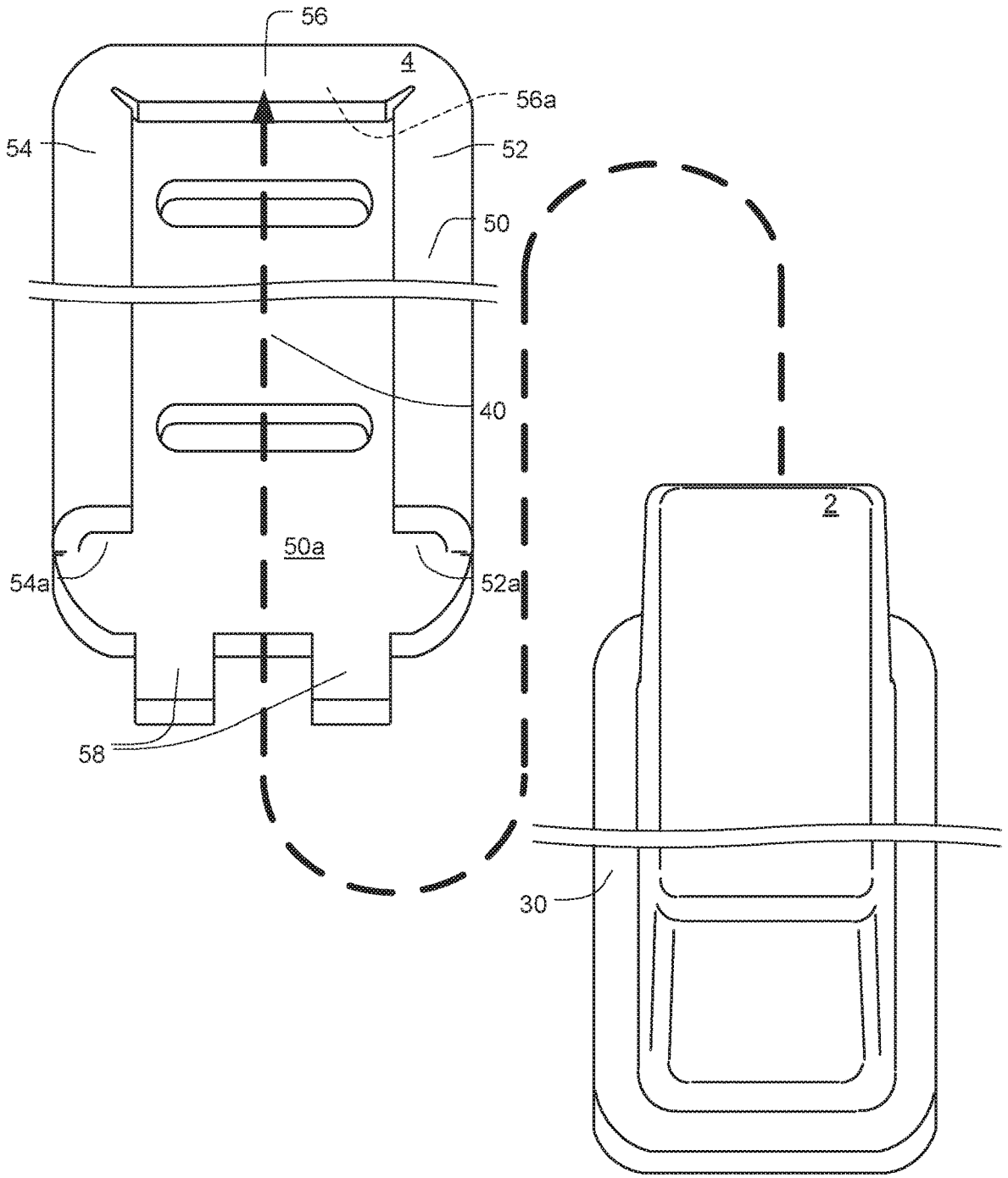

Subsequently, in FIG. 6, the tank part 2 is assembled to the core plate 4. Specifically, a short lateral side of the foot portion 30 of the tank part 2 is first aligned with the slot 50*a* of the core plate 4. Subsequently, the foot portion 30 is inserted through the slot 50*a* and is further moved into the slot 50*a* along the bottom surface of the base portion 40, the first linear channel 52*a*, and the second linear channel 54*a*. The first holder 52 and the second holder 54 at opposed two long lateral sides may serve as guiderails to guide the foot portion 30. In this way, the holder portion 50 may facilitate insertion of the tank part 2 linearly relative to the base portion 40.

The foot portion 30 is further inserted until the foot portion 30 abuts against the inner periphery of third holder portion 56. Thus, the tank part 2 is assembled to the core plate 4.

Before inserting the tank part 2 into the slot 50*a*, the lower surface of the seal member 8 may be applied with lubricant such as grease. The lubricant may mitigate friction between the seal member 8 and the core plate 4 to enable smooth insertion of the tank part 2 through the slot 50*a*.

Figure 7:
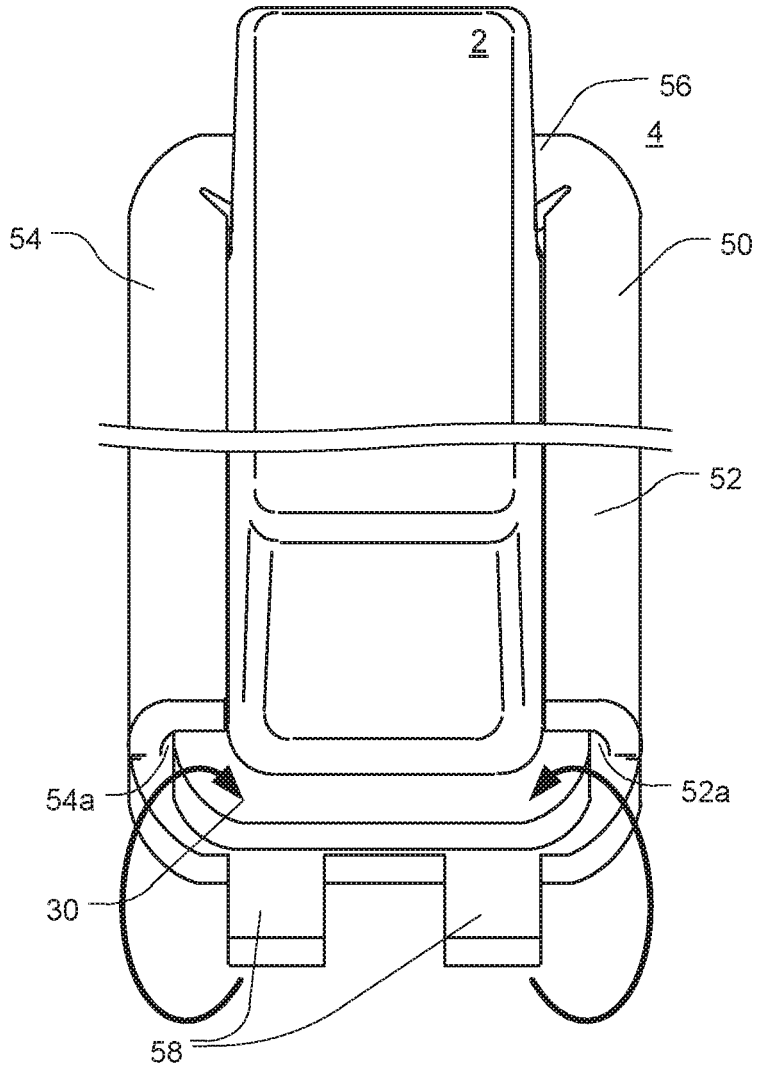

In FIG. 7, as shown by the arrows, the tabs 58 are bent onto the foot portion 30. Specifically, the core plate 4 is held by a jig, and tip ends of the tabs 58 are applied with force from the lower side. The tabs 58 are bent about its root until the tip ends abut onto the foot portion 30. Thus, the tabs 58 are bent to have a U-shaped cross section (refer to FIG. 2). In this way, the tabs 58 are crimped onto the upper surface of the foot portion 30.

Figure 8:
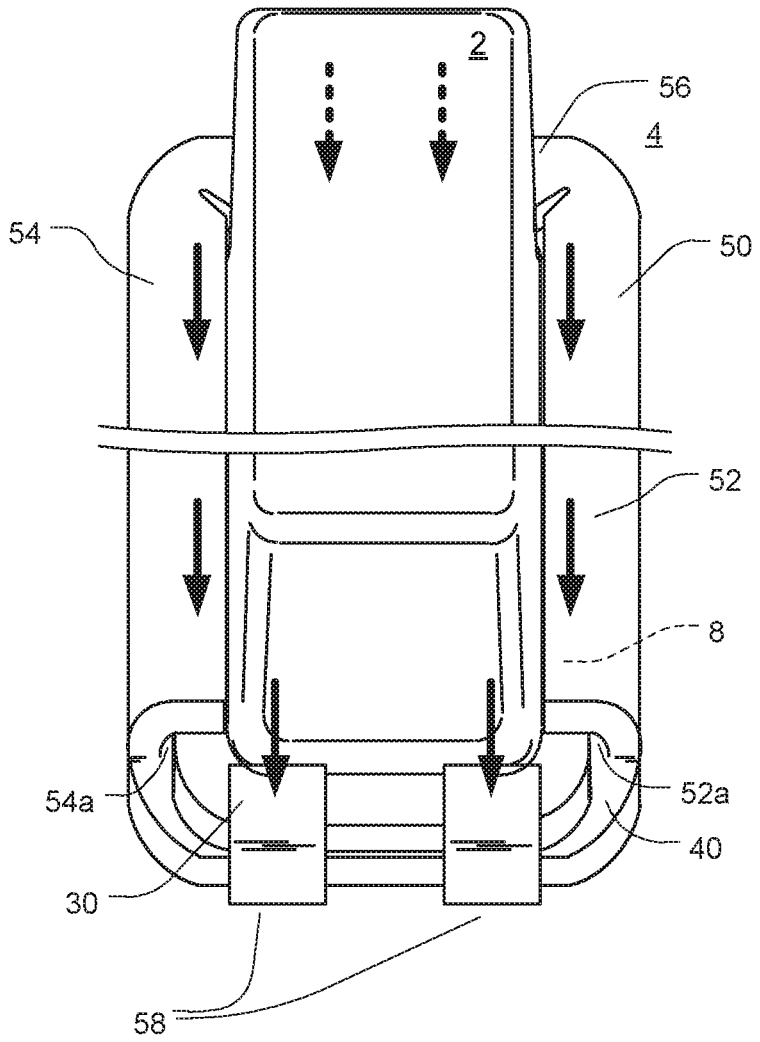

In FIG. 8, as shown by the arrows, compression force is further applied downward onto the holder portion 50 and the tabs 58 by using a compression die. In this way, the holder portion 50 and the tabs 58 compress the seal member 8 via the foot portion 30 onto the base portion 40 by for example, 30% in height. This process may generate residual stress in the holder portion 50 and the tabs 58 to securely grip the foot portion 30 and the seal member 8 with the base portion 40.

(Forming Process of Core Plate)

As follows, a forming process of the core plate 4 will be described with reference to FIGS. 9A to 14.

Figure 9A:
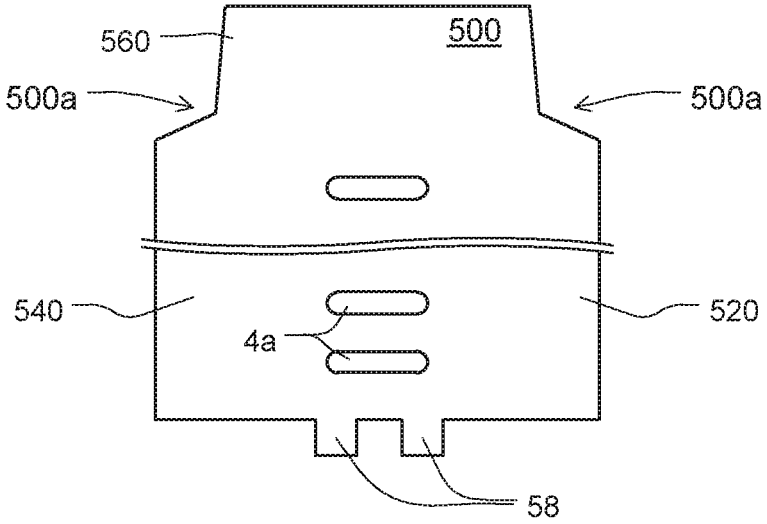
FIG. 9A is a plan view showing a blank.
Figure 9B:
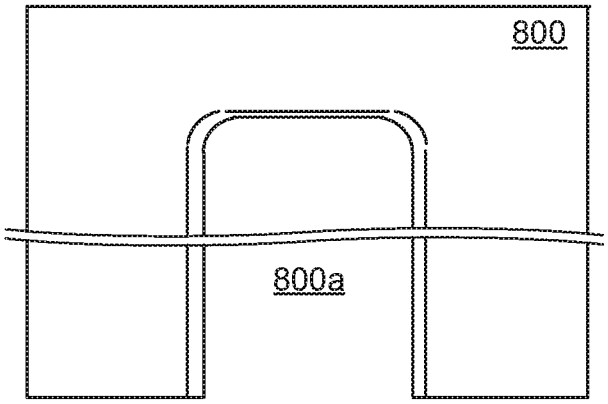
FIG. 9B is a plan view showing a die.

FIGS. 9A and 9B are top views showing a blank 500 and a die 800. The die 800 is for drawing the blank 500. In FIG. 9A, the blank 500 is formed by punching a metallic sheet. The blank 500 has the openings 4*a* and the tabs 58. The blank 500 further has a first margin 520, a second margin 540, and a third margin 560 formed at three lateral sides. Adjacent two margins define a notch 500*a* therebetween. In FIG. 9B, the die 800 has a hollow space as a die cavity 800*a*. The die cavity 800*a* is in a shape corresponding to the outline of the holder portion 50 of the core plate 4.

Figure 10:
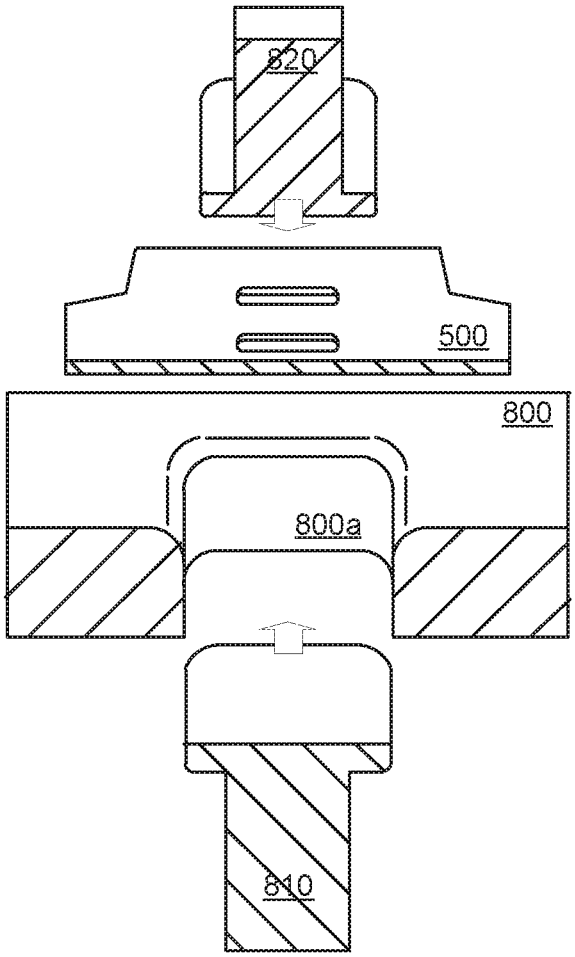
FIGS. 10 to 14 are perspective views showing a manufacturing process for the core plate.

FIGS. 10 to 14 are perspective views showing a manufacturing process of the core plate 4. In FIG. 10, the blank 500 is first set on the die 800 at a predetermined position relative to the die cavity 800*a*. A retainer 810 is moved upward through the die cavity 800*a* to retain the blank 500 from the lower side. A punch 820 is moved downward onto the upper surface of the blank 500.

Figure 11:
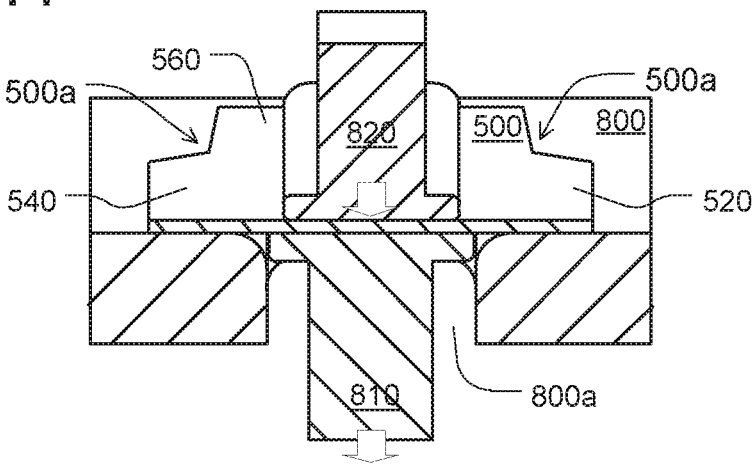

In FIG. 11, the blank 500 set on the die 800 is clamped between the retainer 810 and the punch 820. Subsequently, as shown by the arrows, the punch 820 and the retainer 810 are moved downward together to draw a center portion of the blank 500 into the die cavity 800*a*. As the center portion of the blank 500 is drawn into the die cavity 800*a*, the first margin 520, the second margin 540, and the third margin 560 are also drawn into the die cavity 800*a*.

Figure 12:
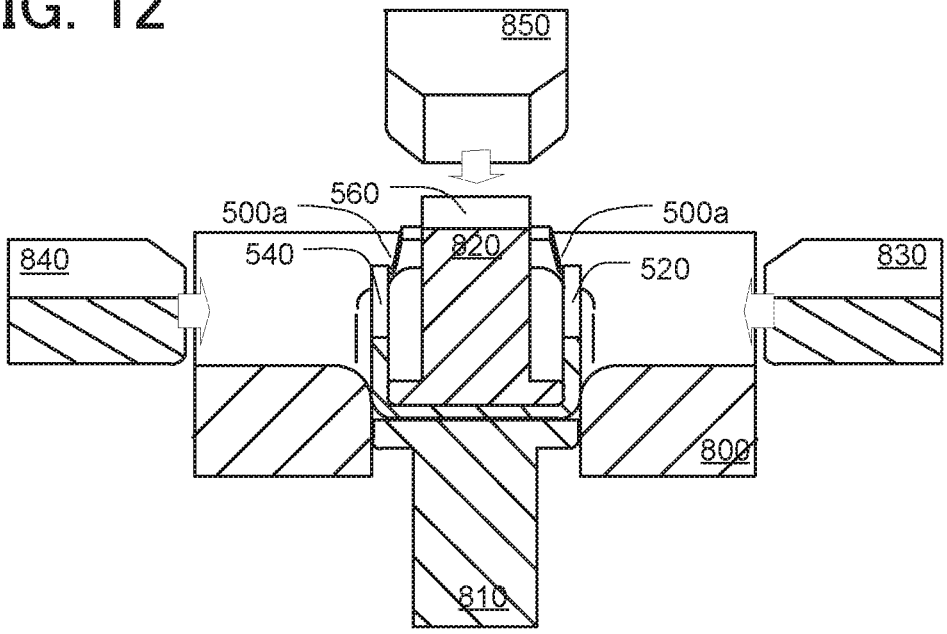

In FIG. 12, the punch 820 and the retainer 810 are stopped after being moved downward by a predetermined depth. The first margin 520, the second margin 540, and the third margin 560 are partially drawn into the die cavity 800*a* and are tilted upward along a die surface defining the die cavity 800*a*. During the present drawing process, as the first margin 520, the second margin 540, and the third margin 560 of the blank 500 are drawn into the die cavity 800*a*, a boundary between adjacent two margins is circumferentially shrunk and drawn into the die cavity 800*a*. The adjacent two margins are, at the boundary, deformed and fused together, and the notches 500*a* are reduced in size.

Subsequently, as shown by the arrows, three cores 830, 840, and 850 are moved horizontally toward the tilted first margin 520, the tilted second margin 540, and the tilted third margin 560, respectively. Each of the cores 830, 840, and 850 bends the corresponding margin along the surface of the punch 820 while being moved toward the center of the punch 820. During the present process, as the first margin 520, the second margin 540, and the third margin 560 are bent, the adjacent two margins are, at the boundary, further deformed and fused together, and the notches 500*a* are further reduced in size.

Figure 13:
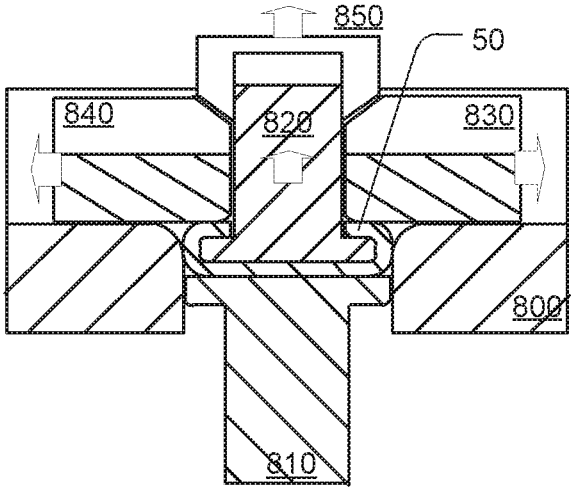

In FIG. 13, the holder portion 50 is formed to be in the C-shape at each long lateral side along the surfaces of the punch 820, die 800, and the cores 830, 840, and 850. Subsequently, as shown by the arrows, the cores 830, 840, and 850 are first moved horizontally away from the punch 820. Thereafter, as shown by the arrows, the punch 820 is moved upward to release the processed blank as the core plate 50 from the die cavity 800*a*.

Figure 14:
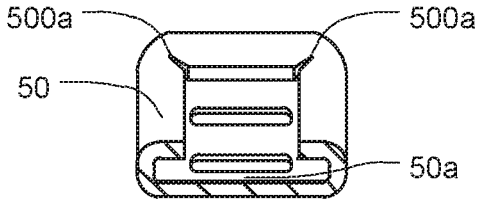

In FIG. 14, the core plate 50 is removed as a manufactured product from the punch 820. Specifically, in FIG. 13, ejector pins (not shown) are used to push the core plate 50 horizontally off the punch, while the punch remains stationary.

Through the deep drawing process of the blank 500 and the bending process of the first margin 520, the second margin 540, and the third margin 560 in FIGS. 11 to 13, the notches 500*a* are reduced in size. Consequently, in FIG. 14, the notches 500*a* are converged toward the inner periphery of the corners of the holder portion 50. The notches 500*a* are deformed into thin V-shapes. Thus, the core plate 4 as manufactured is seamless and rigid at the corners.

(Effect)

According to the present embodiment, each of the first holder 52 and the second holder 54 is one piece continuously extending linearly along the corresponding long lateral side. Therefore, the first holder 52 and the second holder 54 may enable consistent seal between the tank part 2 and the core plate 4.

The first holder 52 and the second holder 54 have the U-shaped cross section forming the first linear channel 52*a* and second linear channel 54*a*, respectively. The first linear channel 52*a* and second linear channel 54*a* continuously extend linearly along the long lateral sides, respectively. The holder portion 50 and the base portion 40 enable insertion of the tank part 2 therethrough. The first linear channel 52*a* and second linear channel 54*a*, which are opposed across the base portion 40, may serve as the guiderails to guide insertion of the foot portion 30 of the tank part 2.

The third holder 56 has the U-shaped cross section forming the third linear channel 56*a*. The third linear channel 56*a* continuously extends linearly along the short lateral side. The third holder 56 serves as a stopper defining an end position of the insertion.

In the present example, the first holder 52 and the second holder 54 extend continuously throughout the lateral sides of the core plate 4 in the longitudinal length. One of the long lateral sides has only the first holder 52 for gripping the foot portion 30. The other of the long lateral sides has only the second holder 54 for gripping the foot portion 30. The present configuration does not require a manufacturing process to crimp a large number of tabs. The continuously formed holder portion 50 may have extensive rigidity to securely grip the foot portion 30 of the tank part 2 and the seal member 8.

In addition, in the present example, the holder portion 50 is seamless at the corners. Therefore, the holder portion 50 may enable to seal extensively between the tank part 2 and the core plate 4.

Second Embodiment

Figure 16:
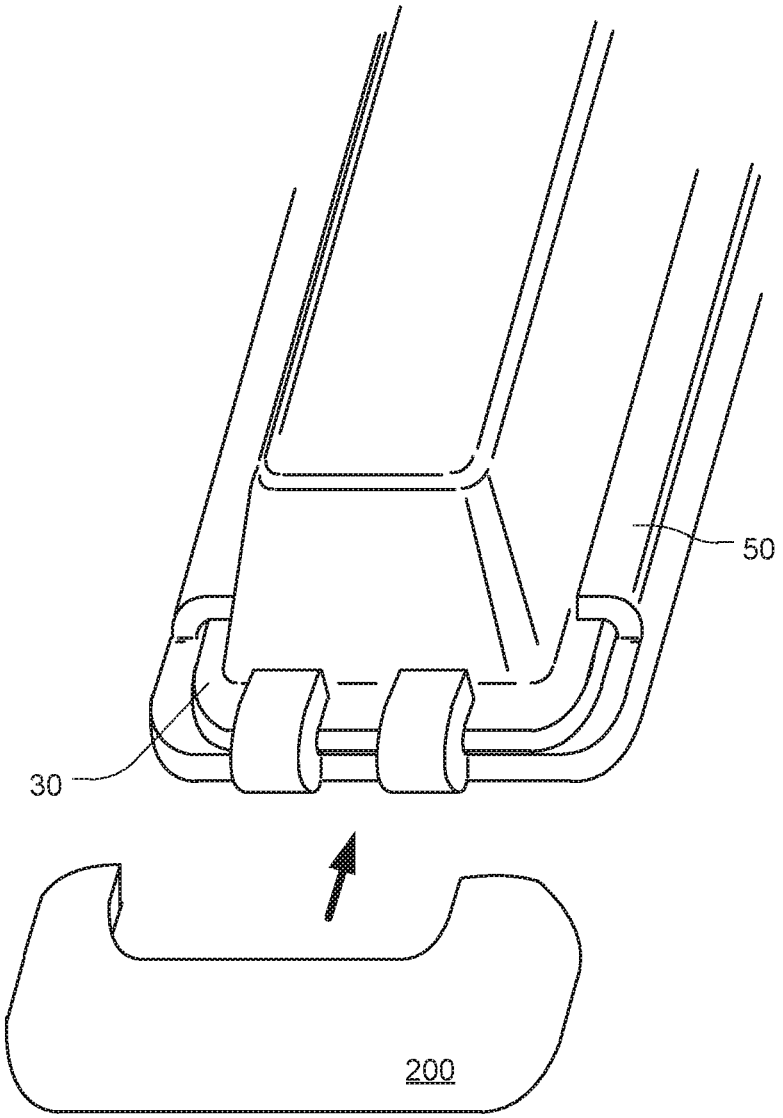
FIG. 16 is a perspective view showing a cap according to a second embodiment.

As shown in FIG. 16, a cap 200 may be equipped to an end of the tank 120, at which the foot portion 30 is partially exposed from the holder portion 50. In this way, the cap 200 entirely surrounds the end of the tank 120. The cap 200 is a bottomed hollow member integrally formed by deep drawing a metallic material. After being mounted to the end of the tank 120, the cap 200 may be compressed downward onto the end of the tank 120. In the present configuration, the end of the tank 120 may be continuously covered by the cap 200 similarly to the other end. In the second embodiment, the tabs 58 may be omitted.

Third Embodiment

Figure 17:
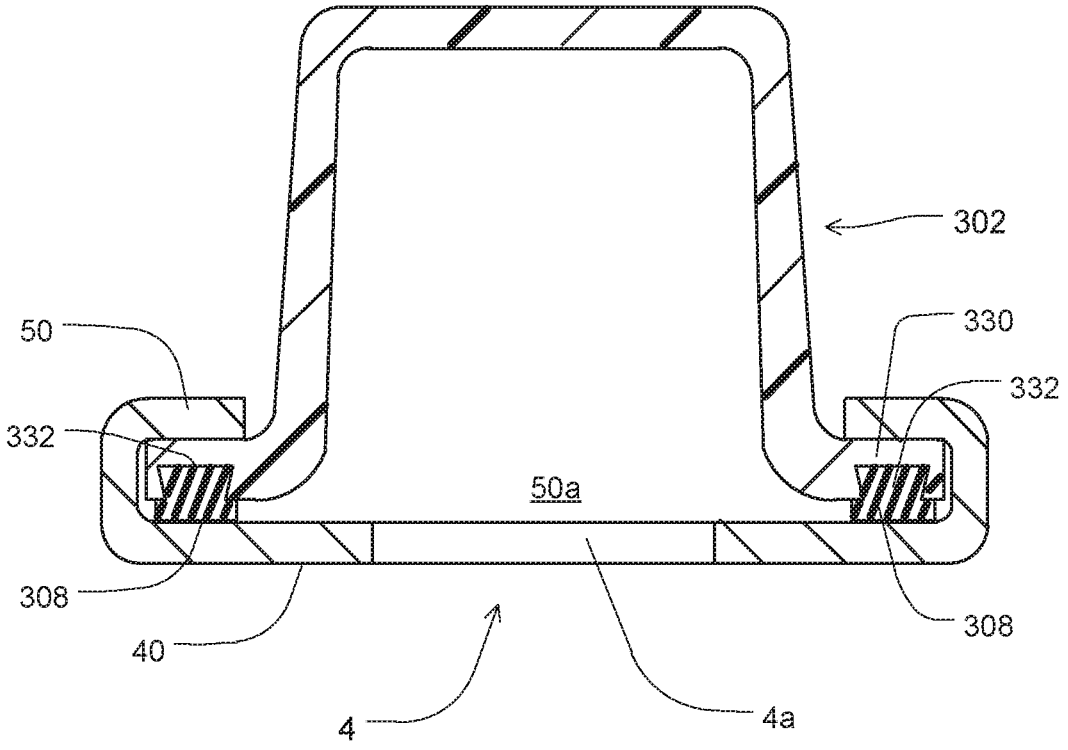
FIG. 17 is a cross sectional view showing a tank according to a third embodiment.

As shown in FIG. 17, a tank part 302 may be inserted-molded with a seal member 308. In this case, a foot portion 330 may have a recess 332 having the cross section in an inverse tapered shape. In the present example, the cross section of the recess 332 is in a ducktail shape. The present configuration may integrate the seal member 308 securely to the foot portion 330.

During insertion of the foot portion 330 through the slot 50*a* of the core plate 4, friction may occur between the seal member 308 and the core plate 4. The seal member 308 would potentially deform due to the friction during the insertion. The present configuration may fortify the interface between the seal member 308 and the foot portion 330 and may avoid deformation of the seal member 308 caused by the friction.

Other Embodiment

The tabs 58 are optional. Provided that the holder portion 50 grips the foot portion 30 and the seal member 8 with sufficient rigidity, the tabs 58 may be omitted.

The cap 200 may be provided to an end of the tank 120 instead of or in addition to the third holder 56.

The tank part 2 may be formed of a metallic material such as an aluminum alloy by die-casting or press working.

The tank may be used for a heat exchanger for various thermal system such as a thermal recovery cycle for a power source and/or a refrigerant cycle.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. A tank for a heat exchanger, the tank comprising:

a tank part including a tank portion and a foot portion, the tank portion defining a space therein and having an opening on one side, the foot portion being in a plate shape extending radially outward from a bottom end of the tank portion on the one side; and a core plate covering the opening, the core plate including a base portion and a holder portion, wherein the base portion is in an elongated rectangular plate shape having a first long lateral side, a second long lateral side opposite to the first long lateral side, a first short lateral side, and a second short lateral side opposite to the first short lateral side, and the holder portion includes:

a first holder that is connected to the first long lateral side and that is deformed to be in contact with and to grip the foot portion of the tank part;

a second holder that is connected to the second long lateral side and that is deformed to be in contact with and to grip the foot portion of the tank part; and a third holder that:

is connected to the first short lateral side;

is deformed to be in contact with and to grip the foot portion of the tank part;

extends along an entire length of the first short lateral side; and is connected to each of the first holder and the second holder;

wherein the third holder is seamlessly connected with the first holder and the second holder at two corners of the holder portion;

wherein the first holder, the third holder, and the second holder have a U-shaped cross section forming a first linear channel, a third linear channel, and a second linear channel, respectively, and the foot portion is partially accommodated in the first linear channel, the third linear channel, and the second linear channel;

wherein the foot portion includes an exposed portion that is located outside of the first holder and the second holder at the second short lateral side; and wherein the foot portion is covered with the first holder, the third holder, and the second holder at the two corners of the holder portion, and the foot portion is exposed at remaining two corners of the holder portion.

2. The tank according to claim 1, further comprising a cap that covers the foot portion partially, the foot portion includes the exposed portion that is located outside of the first holder and the second holder at the second short lateral side, and the cap covers the exposed portion of the foot portion at the second short lateral side.

3. The tank according to claim 1, wherein the core plate further has a tab integrally formed with the base portion and extending radially outward from the second short lateral side of the base portion, and the tab is crimped on the foot portion at the second short lateral side.

4. The tank according to claim 1, further comprising:

a seal member interposed between the foot portion and the base portion.

5. The tank according to claim 4, wherein the seal member is insert-molded with the foot portion.

6. The tank according to claim 1, wherein the first long lateral side is provided with the first holder that has only a single tab and that grips the foot portion, and the second long lateral side is provided with the second holder that has only a single tab and grips the foot portion.

7. The tank according to claim 1, wherein the first holder has only a single tab that extends continuously along the first long lateral side, the second holder has only a single tab that extends continuously along the second long lateral side, and the third holder has only a single tab that extends continuously along the first short lateral side.

* * * * *